US006158051A

United States Patent [19]

Belzidsky

[11] Patent Number: 6,158,051

[45] Date of Patent: Dec. 12, 2000

[54] PROTECTIVE SLEEVE

[76] Inventor: Hugo Belzidsky, 1226 Prospect St., La Jolla, Calif. 92037

[21] Appl. No.: 09/321,140

[22] Filed: May 27, 1999

[51] Int. Cl.[7] ..... A41D 13/00

[52] U.S. Cl. ..... 2/22; 2/16; 2/59

[58] Field of Search ..... 2/22, 24, 16, 59, 2/455–456; 128/878, 882; 602/26, 62–63, 65

[56] References Cited

U.S. PATENT DOCUMENTS

| | | | |
|---|---|---|---|
| 2,785,407 | 3/1957 | Reeder . | |
| 2,800,129 | 7/1957 | Von Swaay . | |
| 3,420,231 | 1/1969 | Edenbaum . | |
| 3,621,489 | 11/1971 | Keller . | |
| 3,906,943 | 9/1975 | Arluck . | |
| 4,153,745 | 5/1979 | Hart . | |
| 4,306,315 | 12/1981 | Castiglia . | |
| 4,832,010 | 5/1989 | Lerman | 2/24 |
| 5,031,240 | 7/1991 | Niierhaus | 2/24 |
| 5,419,161 | 5/1995 | Bodenschatz et al. | 2/22 |
| 5,507,720 | 4/1996 | Lampropoulos . | |
| 5,730,710 | 3/1998 | Eichhhorn et al. | 602/63 |
| 5,784,715 | 7/1998 | Buchannan | 2/22 |
| 5,833,637 | 11/1998 | Pong . | |
| 5,890,224 | 4/1999 | Clark | 2/22 |
| 5,983,391 | 11/1999 | Palmer et al. | 2/16 |

*Primary Examiner*—John J. Calvert
*Assistant Examiner*—Tejash Patel
*Attorney, Agent, or Firm*—Haugen Law Firm PLLP

[57] ABSTRACT

A flexible protective sleeve for use in protecting a wearer's body part, and in particular the bony structures of the arm and leg. The sleeve has a generally tubular shape and includes at least one impact-absorbing portion. One of the impact-absorbing portions is integrally formed along an anterior portion of the sleeve and is of greater thickness than a posterior portion thereof. Other impact-absorbing portions provide protection for the lateral and medial portions of the knee and ankle. First and second reinforced end portions provide mechanical strength against tearing. The sleeve non-compressively adheres to the lower leg of the wearer and maintains the impact-absorbing portion positioned over the shin during use. In an alternative embodiment, a sleeve non-compressively adheres to the arm of the wearer and includes a lower arm impact-absorbing portion and a shoulder impact-absorbing portion.

14 Claims, 6 Drawing Sheets

PROTECTIVE SLEEVE

BACKGROUND OF THE INVENTION

1. Field of the Invention

The present invention relates to a protective device for use in protecting various parts of the human body during physical activity, in particular during sporting activities, and more particularly pertains to a tubular, minimally compressive sleeve having at least one integrally formed impact absorbing portion. The impact-absorbing portion provides for effective dissipation of impact forces and thereby protects the body part underlying the sleeve from injury.

2. Description of the Prior Art

The general problem of providing protection from injury to various parts of the human body has been addressed in the prior art. In particular, various means and apparatus have been developed for protecting or guarding the shin, the ankle, the elbow, the knee, and other body parts. These apparatus find particular application in the field of sports where physical contact is a necessary outcome of participation in the sport. Padding and guards are employed to both minimize painful impacts and decrease the number of injuries such as bone splinters and fractures. One such guard is disclosed in U.S. Pat. No. 2,785,407 to Reeder which shows a thigh protective pad. Pads of the type disclosed in Reeder are intended to be worn underneath various items of clothing including socks, shirts, and pants and as such are generally free to shift position while in use.

Pads and guards find particular application in protecting the tibia, and in particular the anterior shin portion thereof, of soccer players. The most common injury to a soccer player is caused by other players attempting to kick the soccer ball and instead kicking the shin of another player. Guards positioned anteriorly of the shin serve to dissipate the impact of such kicks Shin guards are commercially available as semi-rigid members which are worn under the sock of a player. These guards are generally not comfortable to wear as the material is not soft and abrades the skin of the leg. Furthermore, guards of this type have a tendency to slide down the leg to a position wherein the mobility of the ankle is limited.

A shin guard of a modified design is disclosed in U.S. Pat. No. 4,306,315 to Castiglia. The device includes an elastic tubular member adapted to tightly surround the lower leg of a wearer in the vicinity of the shin. A substantially rigid member is tapered toward the lower end thereof and is adapted to be received in a retaining means in such manner that the rigid member is positioned between the elastic tubular member and the shin of the wearer. This device suffers from the disadvantage of holding onto the leg by compressing the lower leg of the wearer and thereby producing a tourniquet effect and restricting the flow of blood therethrough.

A device for protecting both the shin and ankle of a user is disclosed in U.S. Pat. No. 5,507,720 to Lampropoulos. The protector includes a shin protecting portion and an ankle protecting portion which may be flexibly connected one to the other. The shin protecting portion and ankle protecting portion are attached to the leg and ankle respectively by means of straps. The leg strap necessarily compresses the leg in order to hold the shin protecting portion in position.

It would therefore be desirable to provide a guard for use in protecting various body parts from injury that adheres to the portion of the body to be protected in such manner that a tourniquet effect is avoided. It would further be desirable to provide such a guard having at least one integrally formed impact absorbing portion in a tubular sleeve and thereby obviating the need for positioning pads under items of clothing and/or affixing a plurality of pads to body parts located proximal to one another.

SUMMARY OF THE INVENTION

Accordingly, it is a primary object of the present invention to provide a tubular, non-compressive sleeve having at least one integrally formed impact-absorbing portion for protecting a body part disposed in underlying relationship to the at least one impact-absorbing portion.

It is a further object of applicant's invention to provide a sleeve having integrally formed reinforced edge portions which provide for mechanical strength and resistance to tearing.

It is yet another object of the applicant's invention to provide a sleeve having an impact-absorbing portion for use in protecting a wearer's shin.

It is still another object of applicant's invention to provide a sleeve having a pocket into which an insert can be positioned.

It is yet another object of the applicant's invention to provide a sleeve having an impact-absorbing portion for use in protecting a wearer's knee.

It is still another object of the applicant's invention to provide a sleeve having an impact-absorbing portion for use in protecting a wearer's shoulder and arm.

Various of the foregoing objects, advantages and distinctions of the invention are particularly obtained in a flexible sleeve of generally tubular shape having at least one integrally formed impact absorbing portion and first and second reinforced end portions. The reinforced end portions are non-compressive, the reinforcement providing mechanical strength against tearing but not affecting the elasticity of the urethane.

The material of the sleeve is of such composition so as to adhere with minimal compression to the skin of the wearer. Further, the material is resilient and the sleeve conforms to the shape of the body part thereunder to maintain the sleeve positioned upon the body part. The material may be urethane, polyurethane, or other impact-absorbing material.

In a first preferred embodiment of the invention, the sleeve has a generally truncated conical shape wherein the second reinforced end portion has a smaller diameter than the first reinforced end portion to conform generally to the shape of the lower leg. An impact-absorbing portion is formed along a longitudinal extent thereof for protection of the shin.

In a second alternative embodiment, a sleeve of generally truncated conical shape conforming generally to the shape of the lower leg and having first and second reinforced end portions includes a first impact-absorbing portion formed along a longitudinal extent thereof for protection of the shin. Additionally, a pair of impact-absorbing portions are formed at opposite ends of the sleeve for overlying relationship with the medial and lateral portions of the wearer's ankle and knee.

In a third alternative embodiment, a sleeve of generally truncated conical shape conforming generally to the shape of the lower leg and having first and second reinforced end portions includes an upper portion extendable above the knee of the wearer. A first impact-absorbing portion is formed along a longitudinal extent thereof for protection of the shin and knee. A knee protection portion includes a plurality of knee flexion grooves formed transversely of the first impact-absorbing portion. Additionally, a pair of impact-absorbing portions are formed at an end of the sleeve opposite the upper portion for overlying relationship with the medial and lateral portions of the wearer's ankle.

In a fourth alternative embodiment, a sleeve of generally truncated conical shape conforming generally to the shape of the arm includes a reinforced wrist end portion and a reinforced shoulder end portion. The sleeve further includes a shoulder portion formed at one end thereof, the shoulder portion having an impact-absorbing portion. The shoulder impact-absorbing portion includes a plurality of shoulder flexion grooves formed transversely therethrough. A lower arm impact-absorbing portion is formed at an opposite end of the sleeve and extends from the reinforced wrist end portion to a position whereby the elbow of a wearer is protectively covered thereby. An elbow portion of the lower arm impact-absorbing portion includes a plurality of elbow flexion grooves formed transversely therethrough.

These features of novelty which characterize the invention, together with other objects of the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
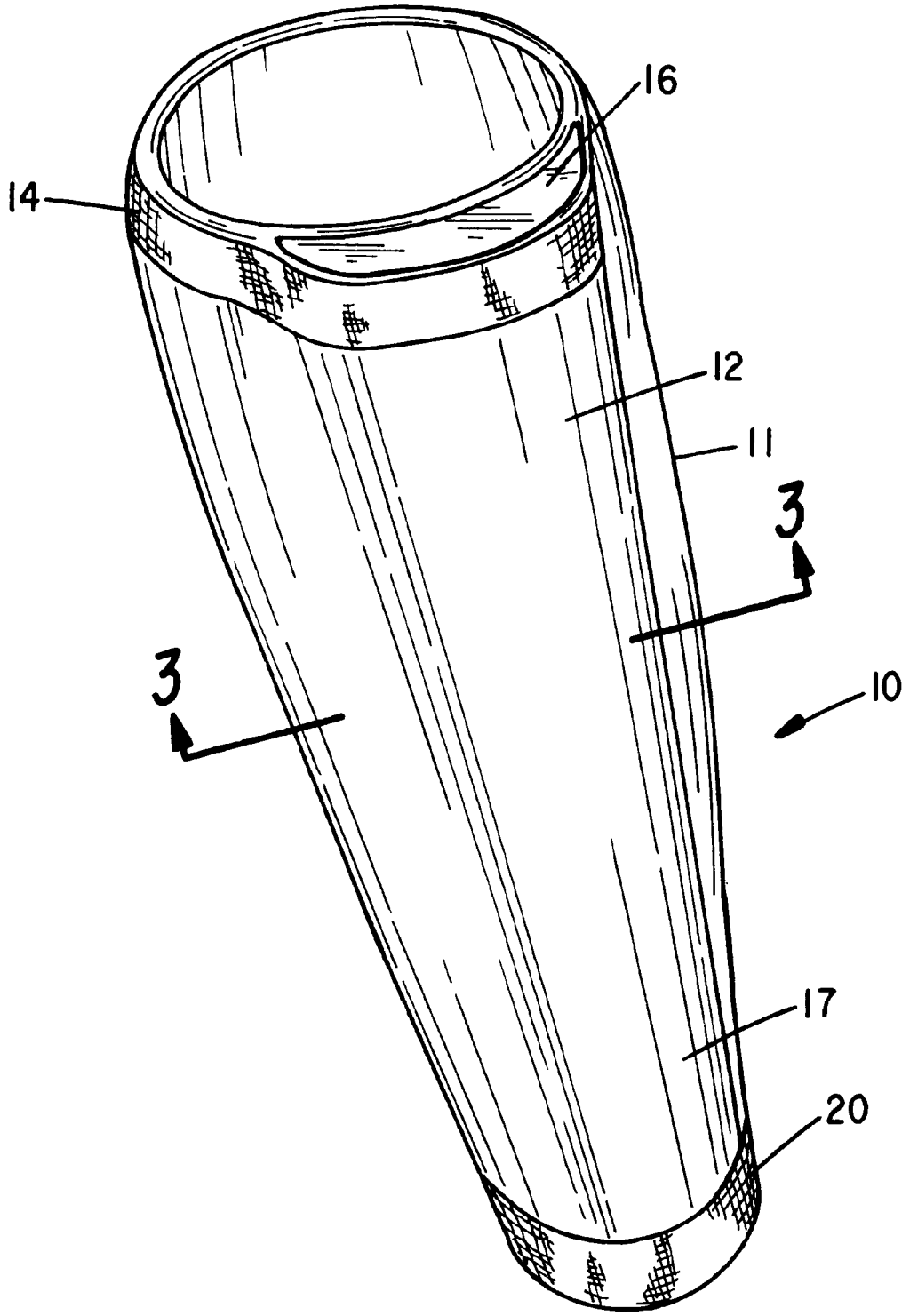
FIG. 1 is a perspective view of a first preferred embodiment showing the sleeve of the present invention.

With reference now to the drawings, and in particular to FIGS. 1 through 7 thereof, a first preferred embodiment of the protective sleeve embodying the principles and concepts of the present invention and generally designated by the reference numeral 10 will be described.

More specifically, the sleeve 10 is shown in FIG. 1 and includes a body 11 which is preferably formed of resiliently stretchable non-compressive material such as urethane or polyurethane. The body 11 is sized and configured to snugly conform to the lower leg of a wearer. The urethane material is advantageously soft at body temperature and naturally adheres to the wearer's skin with negligible compression, thereby preventing blood flow restriction and the shifting or sliding down of the sleeve 10 upon the wearer's leg during physical activity.

Figure 3:
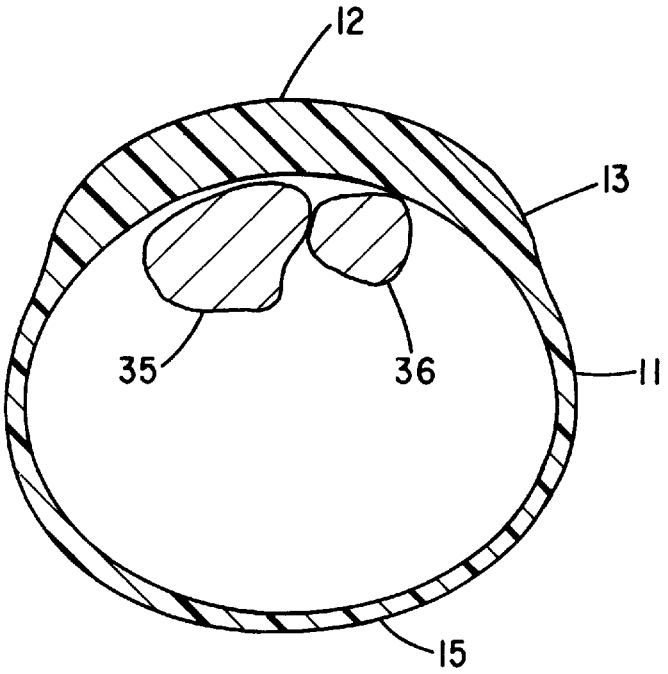
FIG. 3 is a cross sectional view taken along line 3—3 of FIG. 1.

A tapered impact-absorbing portion 12 is formed substantially along a longitudinal extent of the body 11 and spans approximately ⅓ of its circumference in order to protect the shin from side impacts as well as frontal impacts. The tapered impact-absorbing portion 12 includes top portion 16 disposed proximate a first reinforced end portion 14 and a bottom portion 17 disposed proximate a second reinforced end portion 20, the top portion 16 being of greater lateral extent than the bottom portion 17 to generally follow the profile of the lower leg. The impact-absorbing portion 12 is integrally formed by building up the material of the body 11 along an anterior portion 13 thereof as shown in FIG. 3. The resulting configuration provides for an anterior portion 13 of greater thickness than a posterior portion 15.

The first reinforced end portion 14 preferably includes an integral fabric weave which provides for circumferential stretchability or elasticity. Alternatively, the material composition may be such that the same stretchability is effected. The circumferential stretchability allows for elasticity about the upper portion of the lower leg so as not restrict blood flow. The fabric weave additionally provides for added strength at the first end portion 14 and prevents tearing of the sleeve 10. The integral weave does not increase the compression about the lower leg.

The second reinforced end portion 20 is shown disposed opposite the first reinforced end portion 14 and is of smaller diameter than the first reinforced end portion 14. The second reinforced end portion 20 preferably includes an integral weave which provides for limited circumferential stretchability or elasticity and which additionally prevents tearing of the sleeve 10. Alternatively, the material composition may be such that the same stretchability is effected. The integral weave does not increase the compression of the urethane material. The second reinforced end portion 20 is sized to generally conform to the lower portion of the lower leg.

Figure 2:
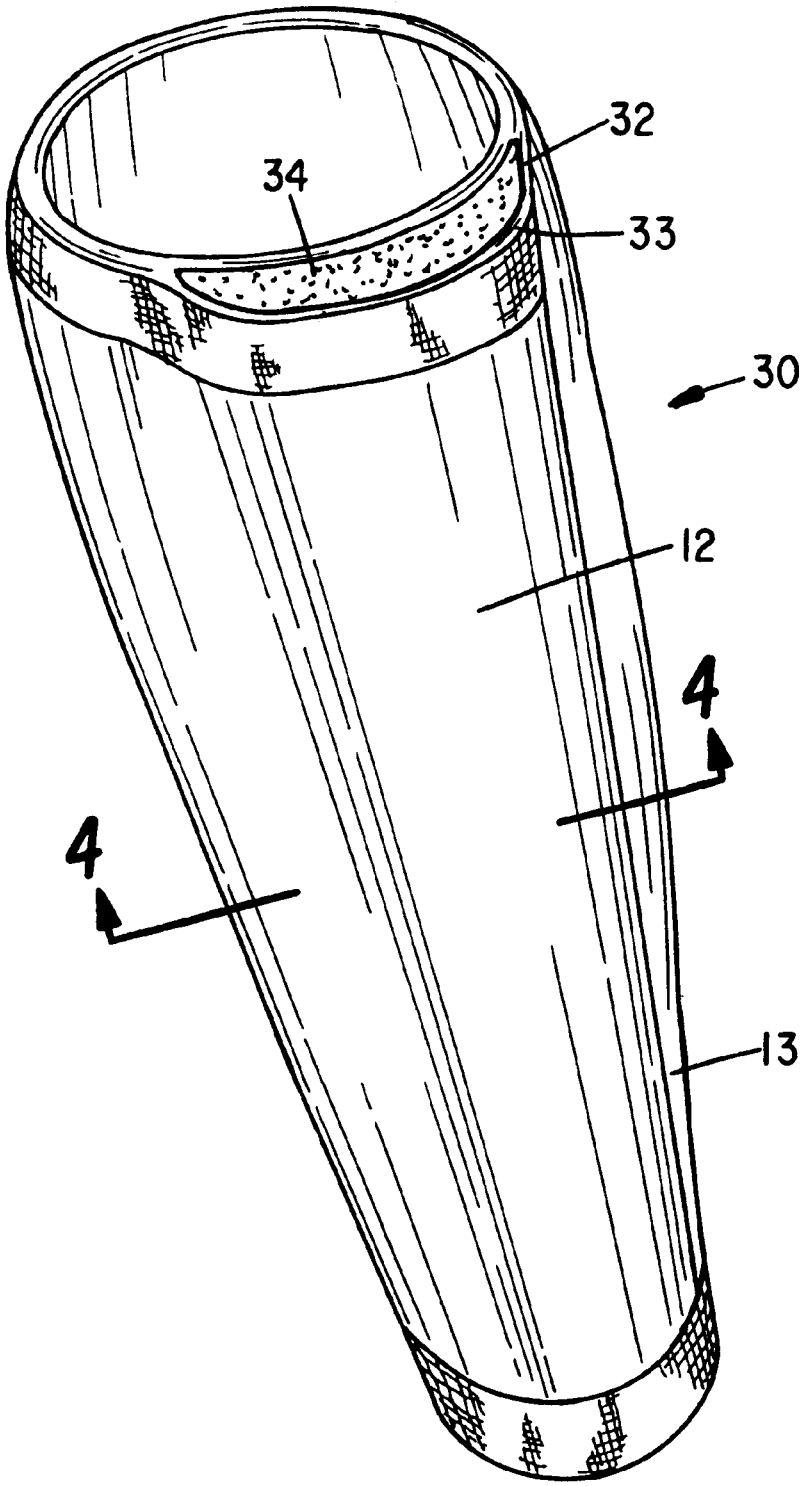
FIG. 2 is a perspective view of an alternative embodiment of the first preferred embodiment.
Figure 4:
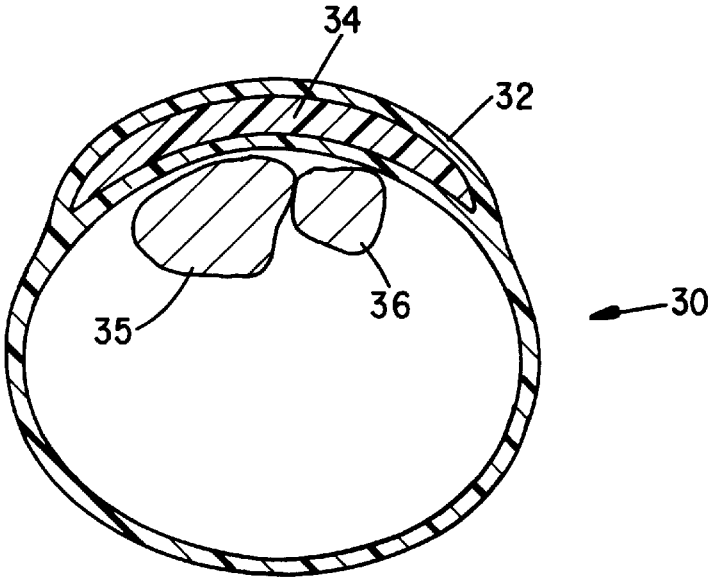
FIG. 4 is a cross sectional view taken along line 4—4 of FIG. 2.

With reference to FIGS. 2 and 4, an alternative embodiment generally designated at 30 of the first preferred embodiment is shown including a tapered pocket 32 formed in the impact-absorbing portion 12. The pocket 32 is preferably formed in such manner that an opening 33 is formed proximate the first reinforced end portion 14. A tapered insert 34 formed of impact resistant nylon, high density urethane or other rigid or semi-rigid material is insertable into the pocket 32 to provide additional impact resistance if desired.

In use the sleeve 10 or 30 is positioned over the lower leg of the wearer in such manner that the impact absorbing portion 12 overlays the tibia 35 as shown in FIGS. 3 and 4. The fibula 36 is also protected by the sleeve of the present invention. The first and second reinforced end portions 14 and 20 provide added mechanical strength and prevent tearing when the sleeve 10 is being positioned past the foot and ankle.

Figure 5:
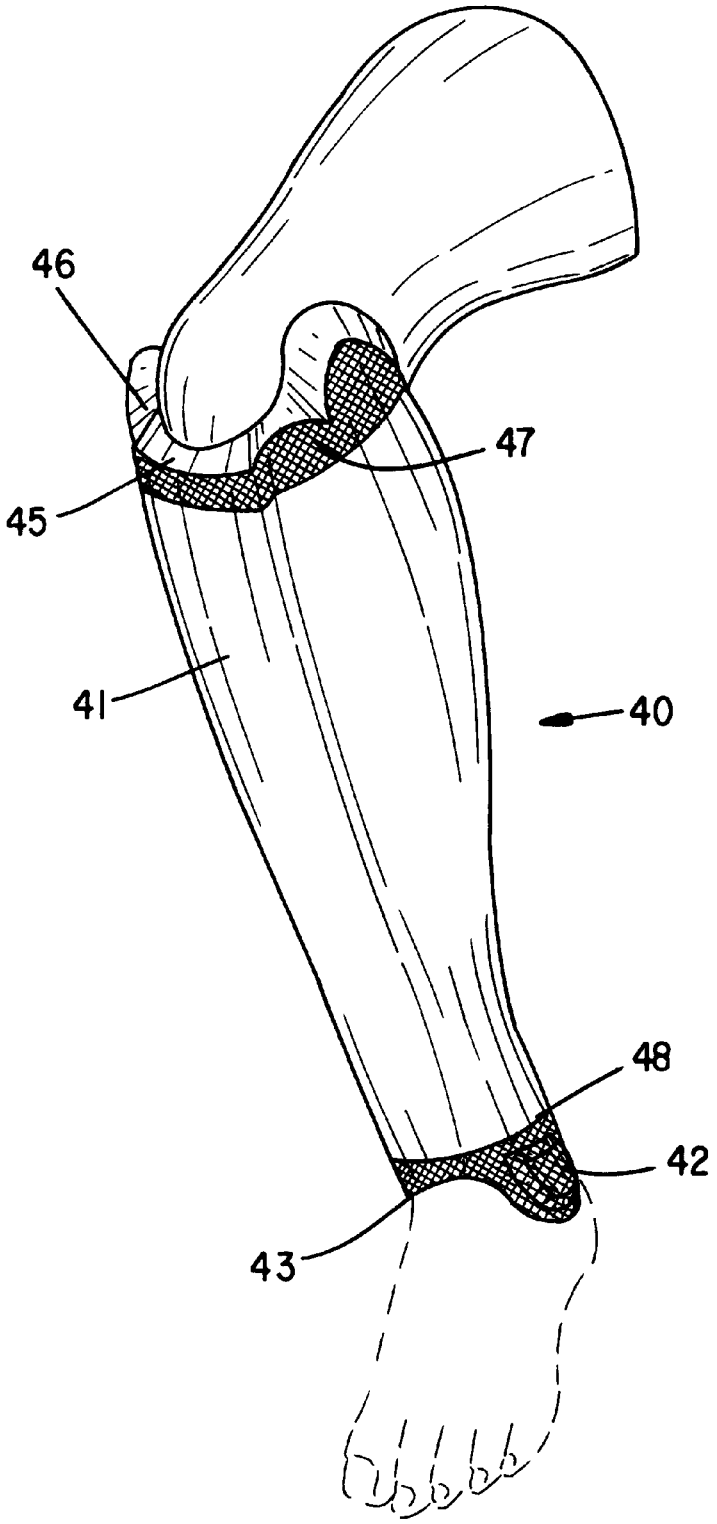
FIG. 5 is a perspective view of a second alternative embodiment.

With reference to FIG. 5, a second alternative embodiment of the present invention is shown including a sleeve generally designated 40. The sleeve 40 is of generally truncated conical configuration conforming generally to the shape of the lower leg. The sleeve 40 includes a first impact-absorbing portion 41 formed as previously described along a longitudinal extent thereof for the protection of the shin. A pair of ankle impact-absorbing portions 42 are formed at a bottom end 43 of the sleeve 40 and extend beyond the bottom end 43 in generally semi-ellipsoidal fashion to overlay the medial and lateral ankle bones of the wearer. A pair of knee impact-absorbing portions 46 are formed at a top end 45 of the sleeve 40 and extend beyond the top end 45 in generally semi-ellipsoidal fashion to overlay the medial and lateral portions of the knee. The ankle and knee impact-absorbing portions 42 and 46 are formed in a manner similar to the first impact-absorbing portion 41.

With continued reference to FIG. 5, the sleeve 40 is shown including a first reinforced end portion 47 and a second reinforced end portion 48 of similar construction and composition as the first and second reinforced end portions 14 and 20. As shown, the first and second reinforced end portions 47 and 48 include the ankle impact-absorbing portions 42 and the knee impact-absorbing portion 46.

Figure 6:
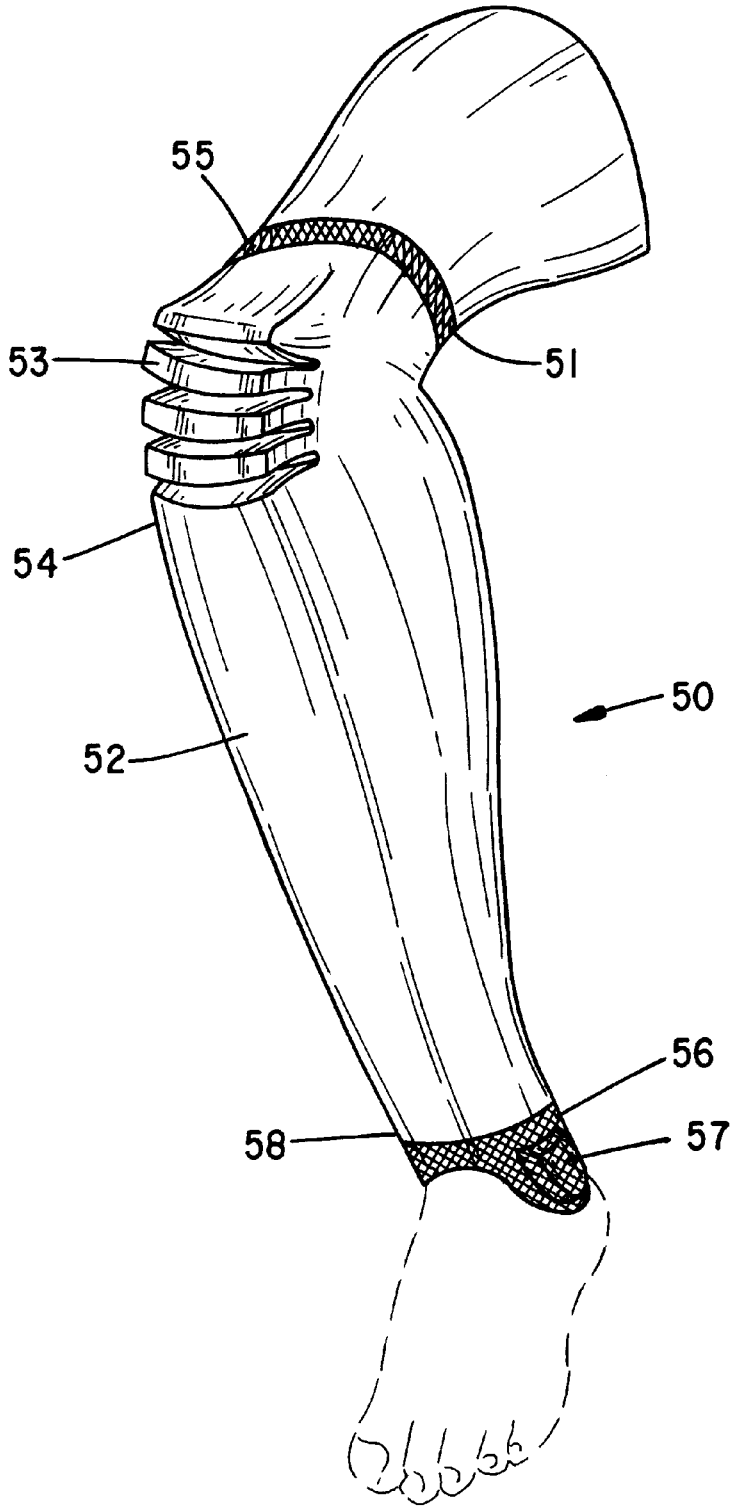
FIG. 6 is a perspective view of a third alternative embodiment.

A third alternative embodiment is shown in FIG. 6 and includes a sleeve generally designated 50 of generally truncated conical shape conforming generally to the shape of the lower leg and knee. The sleeve 50 includes an upper portion 51 which in use extends above the knee of the wearer. A first impact-absorbing portion 52 is formed along a longitudinal extend of the sleeve 50 for overlaying protection of the shin and knee. The first impact-absorbing portion 52 further includes a knee protection portion 53 formed at an upper end 54 thereof. The knee protection portion 53 includes a plurality of knee flexion grooves 55 formed transversely of the longitudinal axis of the sleeve 50. The knee flexion grooves 55 allow for flexion of the knee during use while maintaining the knee protection portion 53 in overlaying relationship to the knee.

First and second reinforced end portions 55 and 56 are of similar construction and composition as the first and second reinforced end portions 14 and 20.

A pair of ankle impact-absorbing portions 57 are formed at a bottom end 58 of the sleeve 50 and extend beyond the bottom end 58 in semi-ellipsoidal fashion to overlay the medial and lateral ankle bones of the wearer. As shown, the second reinforced end portion 56 includes the ankle impact-absorbing portion 57.

Figure 7:
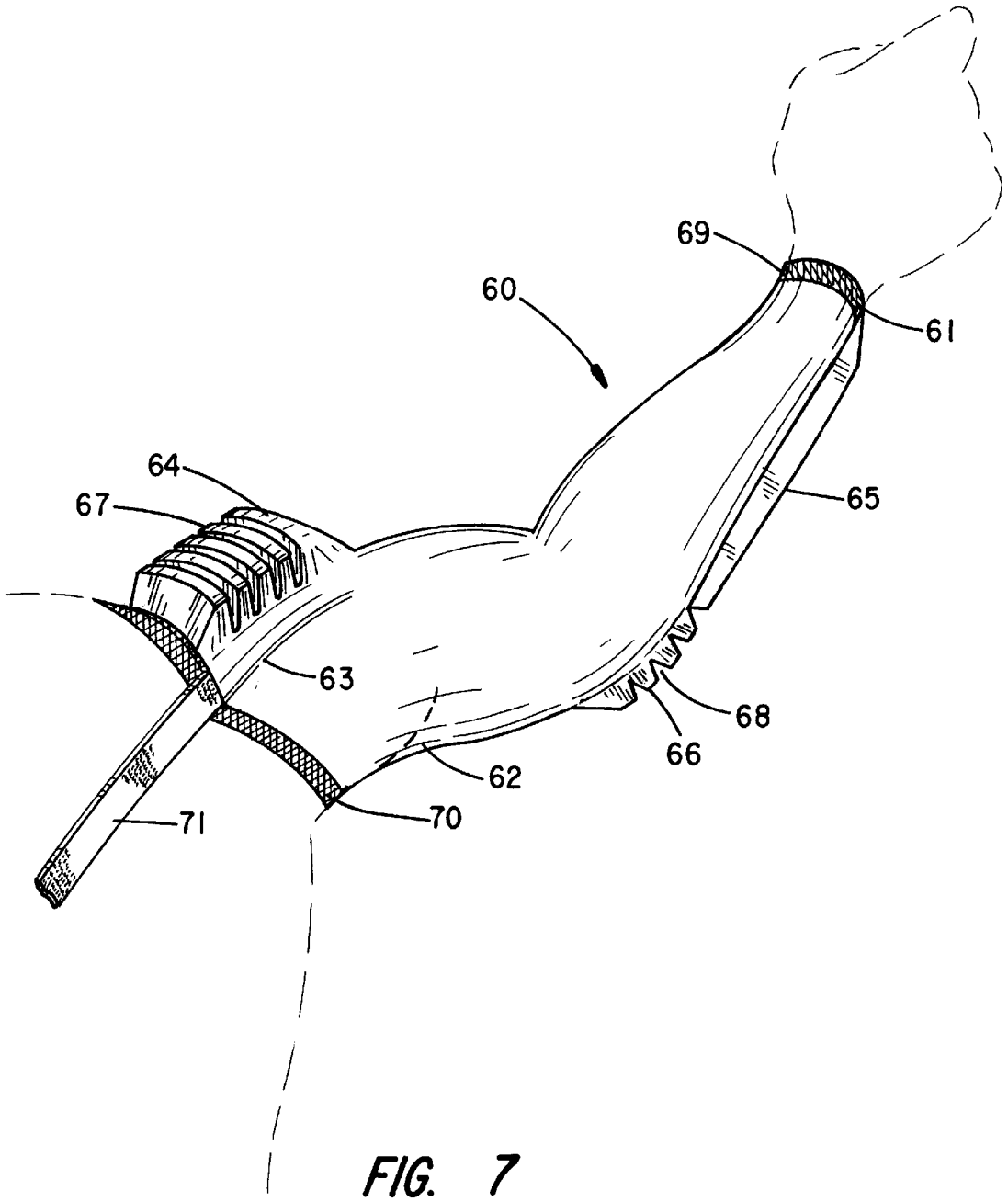
FIG. 7 is a perspective view of a fourth alternative embodiment.

A fourth alternative embodiment is shown in FIG. 7 and includes a sleeve generally designated 60 having a generally truncated conical configuration conforming generally to the shape of an arm. The sleeve 60 includes a reinforced wrist end portion 61 and a reinforced shoulder end portion 62. The sleeve 60 further includes a shoulder portion 63 formed at one end thereof having an impact absorbing portion 64 formed along a longitudinal axis of the sleeve 60. The impact-absorbing portion 64 includes a plurality of shoulder flexion grooves formed transversely therethrough for flexion of the shoulder during use while maintaining the shoulder protection portion 63 in overlaying relationship to the shoulder. A lower arm impact-absorbing portion 65 is formed at an opposite end of the sleeve 60 and extends from the reinforced wrist end portion 61 to a position whereby the elbow of a wearer is protectively covered thereby. An elbow portion 66 of the lower arm impact-absorbing portion 65 formed at an end thereof distally of the wrist end portion 61 includes a plurality of elbow flexion grooves 68 formed transversely therethrough for flexion of the elbow during use while maintaining the elbow protection portion 66 in overlaying relationship to the elbow.

First and second reinforced end portions 69 and 70 are of similar construction and composition as the first and second reinforced end portions 14 and 20. To conform to the shape of the arm, the first reinforced end portion 69 is of smaller diameter than the second reinforced end portion 70.

A strap 71 is shown integrally formed to the sleeve 60 and extending from the shoulder portion 63 from a position adjacent the impact-absorbing portion 64. The strap 71 is adapted to attach to a pair of pants or the like in a conventional manner to help in preventing the sleeve 60 from shifting upon the arm of a wearer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A protective sleeve for use in protecting a body member comprising:

(a) a tubular body member having an impact-absorbing portion formed along an anterior portion thereof extending substantially along a longitudinal extent thereof; a first reinforced end portion; and an opposed second reinforced end portion wherein the tubular body member is sized and configured for minimally compressive engagement to the body member disposed therein; and (b) the protective sleeve further comprising a pair of opposed knee impact-absorbing portions formed proximate the first reinforced end portion and laterally of the anterior portion and a pair of opposed ankle impact-absorbing portions formed proximate the second reinforced end portion and laterally of the anterior portion.

2. The protective sleeve of claim 1 wherein the first reinforced end portion further comprises an integral fabric weave, the integral fabric weave providing for circumferential elasticity and mechanical strength.

3. The protective sleeve of claim 1 wherein the second reinforced end portion further comprises an integral fabric weave, the integral fabric weave providing for circumferential elasticity and mechanical strength.

4. The protective sleeve of claim 1 wherein the impact absorbing portion further comprises an anterior portion of greater thickness than a body member posterior portion.

5. The protective sleeve of claim 1 wherein the sleeve is manufactured from an impact-absorbing material.

6. The protective sleeve of claim 1 wherein the sleeve is manufactured from urethane.

7. The protective sleeve of claim 1 wherein the sleeve is manufactured from polyurethane.

8. The protective sleeve of claim 1 wherein the sleeve has a truncated conical configuration, the first reinforced end portion being of smaller diameter than the second reinforced end portion.

9. The protective sleeve of claim 1 wherein the impact-absorbing portion is of tapered configuration.

10. The protective sleeve of claim 1 wherein the impact-absorbing portion further comprises a pocket formed therein, the pocket for receiving an insert.

11. The protective sleeve of claim 10 wherein the insert is formed of impact resistant semi-rigid material.

12. The protective sleeve of claim 10 wherein the insert is formed of impact resistant rigid material.

13. A protective sleeve for use in protecting a body member comprising:

(a) a tubular body member having an impact-absorbing portion formed along an anterior portion thereof and extending substantially along a longitudinal extent thereof; a first reinforced end portion; and an opposed second reinforced end portion wherein the tubular body member is sized and configured for minimally compressive engagement to the body member disposed therein; and (b) said impact-absorbing portion of the protective sleeve further comprises an upper end, with the upper end further comprising a knee impact-absorbing portion; and (c) said knee impact-absorbing portion having a plurality of transverse grooves formed therethrough.

14. A protective sleeve for use in protecting a body member comprising:

(a) a tubular body member having an impact-absorbing portion formed along an anterior portion thereof and extending substantially along a longitudinal extent thereof; a first reinforced end portion, and an opposed second reinforced end portion wherein the tubular body member is sized and configured for minimally compressive engagement to the body member disposed therein; and with (b) said protective sleeve further comprising a pair of opposed ankle impact-absorbing portions formed proximate said second reinforced end portion and laterally of said anterior portion.

* * * * *